US008484877B2

(12) United States Patent
Zimmerman

(10) Patent No.: US 8,484,877 B2
(45) Date of Patent: Jul. 16, 2013

(54) RIFLE UPPER RECEIVER WITH INTEGRAL MAGAZINE WELL

(76) Inventor: Michael Dwain Zimmerman, Prescott, AZ (US)

( * ) Notice: Subject to any disclaimer, the term of this patent is extended or adjusted under 35 U.S.C. 154(b) by 799 days.

(21) Appl. No.: 12/589,457

(22) Filed: Oct. 23, 2009

(65) Prior Publication Data

US 2011/0094136 A1 Apr. 28, 2011

(51) Int. Cl.
*F41A 21/00* (2006.01)

(52) U.S. Cl.
USPC ..... 42/75.01; 42/71.01; 42/75.03; 42/75.02; 42/16; 42/6

(58) Field of Classification Search
USPC ..... 42/75.01, 71.01, 75.03, 75.02, 16, 42/6
See application file for complete search history.

(56) References Cited

U.S. PATENT DOCUMENTS 5,155,292 A * 10/1992 Rostcil et al. ..... 89/167
7,313,883 B2 * 1/2008 Leitner-Wise ..... 42/75.02
D590,473 S 4/2009 Fitzpatrick et al.
7,971,379 B2 * 7/2011 Robinson et al. ..... 42/7
7,971,382 B2 * 7/2011 Robinson et al. ..... 42/75.02
7,975,595 B2 * 7/2011 Robinson et al. ..... 89/185
8,096,074 B2 * 1/2012 Robinson et al. ..... 42/16
2005/0262752 A1 * 12/2005 Robinson et al. ..... 42/71.01
2006/0277810 A1 * 12/2006 Leitner-Wise ..... 42/75.03
2007/0033850 A1 * 2/2007 Murello et al. ..... 42/71.01
2008/0168695 A1 7/2008 Nakayama
2009/0000173 A1 * 1/2009 Robinson et al. ..... 42/75.02
2009/0007477 A1 * 1/2009 Robinson et al. ..... 42/75.02
2009/0031606 A1 * 2/2009 Robinson et al. ..... 42/16
2009/0031607 A1 * 2/2009 Robinson et al. ..... 42/16
2010/0186276 A1 * 7/2010 Herring ..... 42/6
2011/0094136 A1 * 4/2011 Zimmerman ..... 42/6
2011/0209607 A1 * 9/2011 St. George ..... 89/191.01

OTHER PUBLICATIONS

Magpul Masada™ Adaptive Combat Weapon System Tech Note.

* cited by examiner

*Primary Examiner* — Michelle Clement
(74) *Attorney, Agent, or Firm* — Bennet K. Langlotz; Langlotz Patent & Trademark Works, Inc.

(57) ABSTRACT

Rifle upper receivers with integral magazine wells include an extruded elongate inverted U-shaped channel with an interior bore. The interior of the channel has elements formed as surfaces of extrusion. The surfaces of extrusion provide guidance and support for a magazine and trigger guard assembly pins. The present invention is manufactured by extruding an elongate tube in a closed-box profile with an interior bore, milling a series of slots into the top of the tube, machining a bottom channel opening by removing portions of the bottom of the tube, machining holes in the sides of the tube, and machining a recess in the top of the interior of the tube.

20 Claims, 11 Drawing Sheets

RIFLE UPPER RECEIVER WITH INTEGRAL MAGAZINE WELL

FIELD OF THE INVENTION

The present invention relates to a rifle upper receiver with integral magazine well that receives a magazine within the upper receiver.

BACKGROUND OF THE INVENTION

Ruger® 10/22® rifles manufactured by Sturm, Ruger & Co., Inc. of Southport, Conn. are one of the most successful recreational shooting rifles in history. The rifle's popularity stems from its origins as one of the first modern rifles chambered in .22 caliber that featured a quality design suitable for use by adults. Its easy handling characteristics, negligible recoil, and inexpensive ammunition make it ideal for young or inexperienced shooters. However, the rifle is also widely used by small game hunters and those who want an inexpensive rifle firing inexpensive ammunition for target and plinking use. These characteristics also make it useful as a training rifle for police and military applications. A wide range of after-market modifications are available to improve the rifle's performance, augment the rifle's appearance, and increase its magazine capacity.

The rifle's design employs an integrated modular subassembly approach depicted in FIG. 1. The modular construction of the components means the average person can easily replace any part of the gun using only a screwdriver, a hex key, and simple punches.

The trigger guard assembly 122 of the 10/22® rifle 100 contains the entire firing mechanism, which features a short-throw, high-speed swinging hammer 158 for rapid lock time. The trigger guard assembly is held together by trigger guard assembly pins 148 inserted in trigger guard assembly pin holes 124. The one-piece .22 Long Rifle (LR) receiver 136 is milled from a solid block of cast aluminum and is drilled and tapped for a tip-off scope mount adaptor supplied with the rifle. The bolt assembly 126 reciprocates within the receiver. The motion of the bolt assembly 126 is controlled by a cocking handle 130 mounted on a guide rod 132 and a recoil stop pin 142 attached to the receiver. The magazine 116 is a compact rotary 10-shot unit.

The barrel 102 uses a unique attachment technique where the barrel is screwed rather than pinned into the frame. The barrel tenon 104 is not threaded, but attachment of the barrel to the receiver involves two barrel retainer screws 106 and a barrel retainer 108 that is received by a slot in the underside of the barrel. The forward portion of the barrel is secured to the stock assembly 118 by a barrel band 112 that is tightened by a barrel band screw 114. A takedown screw 120 further secures the barrel within the stock assembly. The upper portion of the barrel is left exposed by the stock assembly. This construction makes removal and replacement of the barrel, which would otherwise require a gunsmith's work with most other rifles, much easier.

The rifle is available in a wide variety of configurations, including multiple barrel lengths. A shorter stock is used with the shortest barrel. Otherwise, longer barrels protrude farther from the stock than shorter barrels do. A different receiver and magazine are required for use in the .22 magnum version of the rifle because the magnum cartridge is longer and has a larger case diameter than the standard Long Rifle cartridge.

In order to maximize the rifle's utility as a training weapon for users of the AR-15 rifle platform, it is desirable to modify a standard 10/22® rifle to closely resemble the appearance and geometry of an AR-15 while continuing to use standard 10/22® rifle internal components. Although many customizations of the 10/22® rifle exist, they do not feature a receiver that covers the top portion of the barrel or fully floats the forward portion of the barrel within the receiver as an AR-15 rifle's upper receiver may. Furthermore, longer barrels are typically allowed to protrude farther from the stock because it is prohibitively expensive to make a custom stock length for each barrel length. This leaves a lengthy exposed portion of barrel between the end of the stock and the beginning of a suppressor screwed onto the end of the barrel, which is cosmetically unappealing to the shooter.

Upper receivers made from aluminum extruded in a closed-box profile are known. One such upper receiver is featured in the Magpul Masada™ Adaptive Combat Weapon System designed by Magpul Military Industries of Erie, Colo. This upper receiver is shown in U.S. Pat. No. D590,473 to Fitzpatrick et al. The upper receiver has a continuous military specification top rail milled into its top and receives a barrel trunnion. The barrel trunnion acts as part of a quickly changeable barrel system that is described in detail in the United States Patent Application 2008/0168695 of Nakayama. A separate free float hand guard must be attached to the trunnion to effectively extend the length of the upper receiver to cover the rear portion of the barrel and to provide mounting points and/or integrated rails on the sides and bottom of the firearm. Two lengths of hand guard are available to adjust how much of the barrel protrudes from the hand guard.

The Masada™ upper receiver suffers the disadvantage of requiring a magazine well that is integral to the trigger pack housing rather than to the upper receiver. Furthermore, the upper receiver requires use of a separate hand guard that is attached to the trunnion in order to cover the barrel. This means that the trunnion cannot merely be repositioned within the upper receiver to accommodate a magnum load. Instead, an entirely new upper receiver design would be required. Finally, the Masada™ Adaptive Combat Weapon System requires relatively expensive M16 barrels, magazines, and ammunition instead of the much cheaper components and ammunition used with the 10/22® rifle.

Therefore, a need exists for a new and improved rifle upper receiver with integral magazine well that receives a magazine within the upper receiver. In this regard, the various embodiments of the present invention substantially fulfill at least some of these needs. In this respect, the rifle upper receiver with integral magazine well according to the present invention substantially departs from the conventional concepts and designs of the prior art, and in doing so provides an apparatus primarily developed for the purpose of receiving a magazine within the upper receiver.

SUMMARY OF THE INVENTION

The present invention provides an improved rifle upper receiver with integral magazine well, and overcomes the above-mentioned disadvantages and drawbacks of the prior art. As such, the general purpose of the present invention, which will be described subsequently in greater detail, is to provide an improved rifle upper receiver with integral magazine well that has all the advantages of the prior art mentioned above.

To attain this, the preferred embodiment of the present invention essentially comprises an extruded elongate inverted U-shaped channel with an interior bore. The interior of the channel has elements formed as surfaces of extrusion. The surfaces of extrusion provide guidance and support for a magazine and trigger guard assembly pins. The present invention is manufactured by extruding an elongate tube in a closed-box profile with an interior bore, milling a series of slots into the top of the tube, machining a bottom channel opening by removing portions of the bottom of the tube, machining holes in the sides of the tube, and machining a recess in the top of the interior of the tube. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
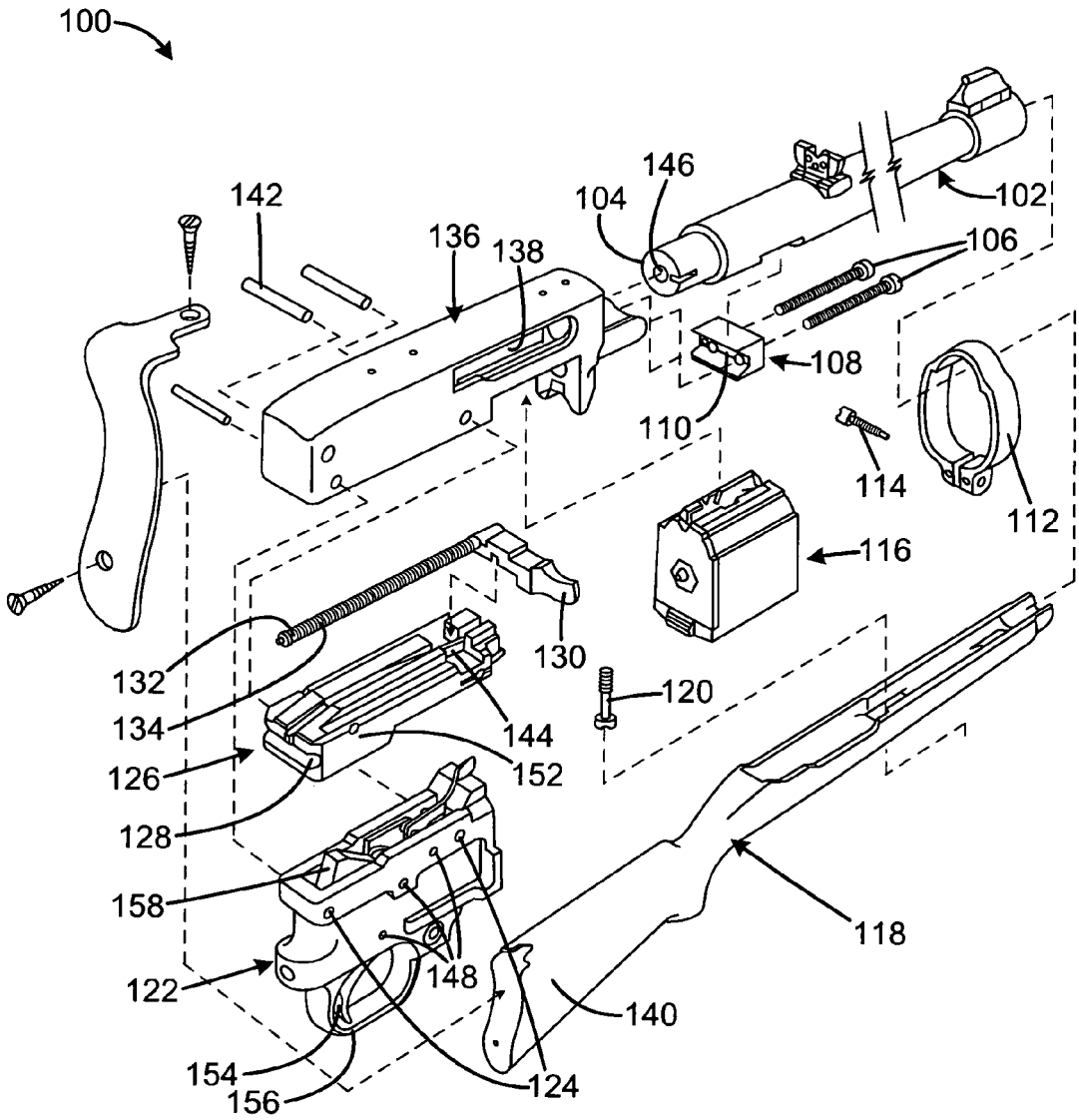
FIG. 1 PRIOR ART
FIG. 1 is a top perspective exploded view of a Ruger® 10/22® rifle of the prior art.

A preferred embodiment of the rifle upper receiver with integral magazine well of the present invention is shown and generally designated by the reference numeral 10.

Figure 2:
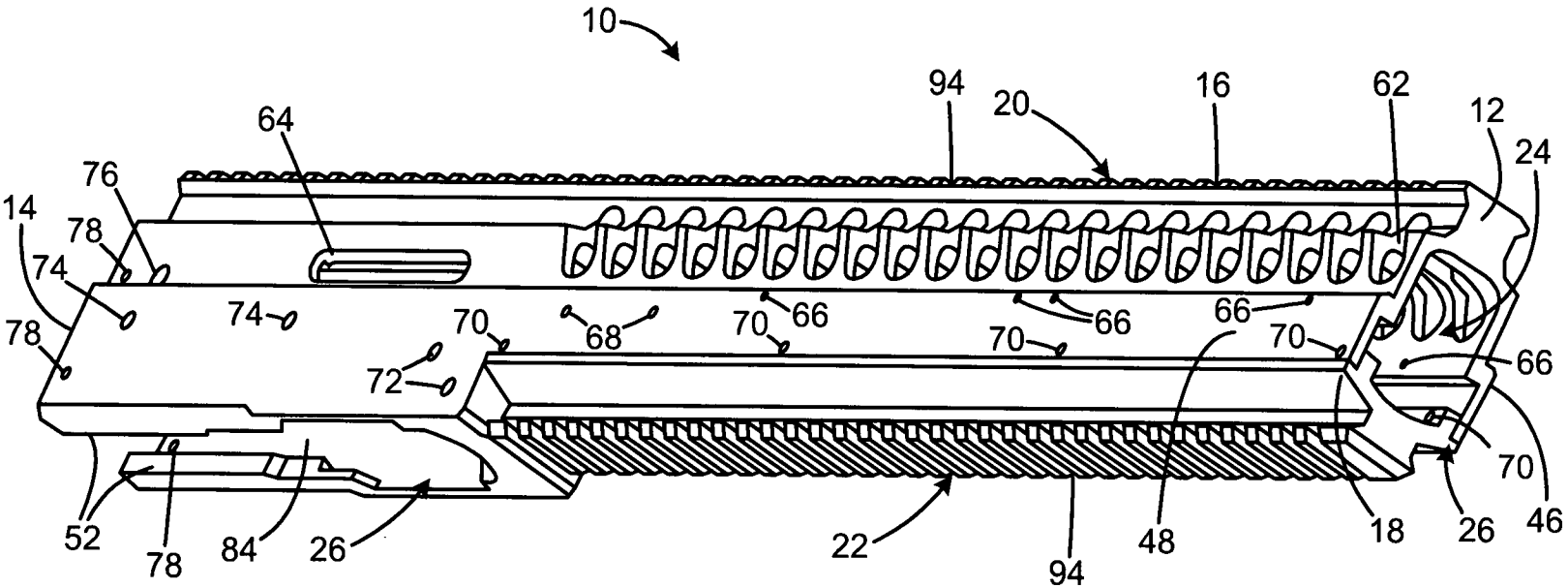
FIG. 2 is a right side perspective view of the current embodiment of the rifle upper receiver with integral magazine well constructed in accordance with the principles of the present invention.

FIG. 2 illustrates the improved rifle upper receiver with integral magazine well 10 of the present invention. More particularly, the upper receiver 10 is a machined aluminum extrusion with top 16, bottom 18, left 46, and right 48 sides and front 12 and rear 14 ends. An interior bore 24 extends the length of the upper receiver, resulting in the upper receiver having a hollow interior and open front and rear ends.

The bottom of the upper receiver is open as well, defining a bottom channel 26. The front portion of the bottom channel is covered by a removable bottom rail 22. The bottom rail has a series of slots 94 in it. The rear portion of the bottom channel remains open to receive parts. The middle of the open rear portion of the bottom channel defines a magazine well 84. The rear of the open rear portion of the bottom channel is defined by two lower pin retention rails 52.

The rear portion of the left and right sides above the open rear portion of the bottom channel are taller than the forward portion of the left and right sides above the bottom rail. This prevents the bottom rail from protruding below the bottom rear portion of the upper receiver.

The top of the upper receiver has a series of slots 94 in it that define a top rail 20. The top rail extends the length of the upper receiver.

The left side 46 and right side 48 of the exterior of the upper receiver are mirror images of one another except for an ejection port 64, which is present only on the right side for right-handed cocking as illustrated or on only the left side for left-handed cocking. A number of holes in paired alignment are present in the left and right sides of the upper receiver. A series of lightening cuts 62 are located in the left side 46 and right side 48 of the front 12 of the receiver. Two pairs of side rail attachment points 66 are positioned in the left and right sides of the upper receiver beneath the lightening cuts. Two harmonic dampener mounting holes 68 are present below and behind the side rail attachment points in the left side 46 and right side 48 of the front 12 of the receiver. Four bottom rail mounting holes 70 are located below the harmonic damper mounting holes in the left side 46 and right side 48 of the front 12 of the receiver. Two trunnion attachment holes 72 are positioned behind the bottom rail mounting holes in the left side 46 and right side 48 of the front 12 of the receiver. Two trigger guard assembly mounting holes 74 are present behind the trunnion attachment holes in the left side 46 and right side 48 of the front 12 of the receiver. A recoil pin mounting hole 76 is located behind and approximately at the same level as the ejection port in the left side 46 and right side 48 of the front 12 of the receiver. Two pistol grip mounting holes 78 are positioned behind the trigger guard assembly mounting holes and recoil pin mounting hole in the left side 46 and right side 48 of the front 12 of the receiver.

Figure 3:
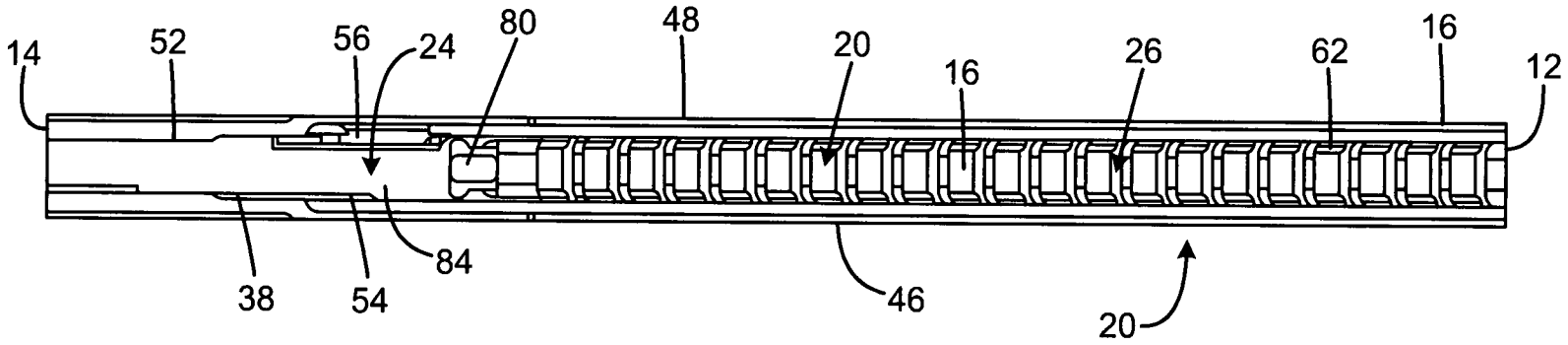
FIG. 3 is a bottom view of the current embodiment of the rifle upper receiver with integral magazine well of the present invention with the bottom rail removed.

FIG. 3 illustrates the improved rifle upper receiver with integral magazine well 10 of the present invention with the bottom rail 22 removed. More particularly, the bottom 18 of the upper receiver defines a bottom channel 26 that extends from the front 12 to the rear 14. The bottom channel makes the upper receiver have an inverted U-shaped cross-section. The interior bore 24 and a number of features within the interior of the upper receiver can be seen.

The lightening cuts 62 in the forward portion of the underside of the top rail 20 are visible through the bottom channel and interior bore. A recoil lug hole 80 is present in the underside of the top 16 of the upper receiver behind the top rail. A first magazine rail 54 is visible on the left side 46 behind the recoil lug hole, and a guide rod channel 38 is visible on the left side behind the first magazine rail. A second magazine rail 56 is visible on the right side 48 behind the recoil lug hole. The magazine rails define the portion of the bottom channel that serves as the magazine well 84. The lower pin retention rails 52 are visible on both sides of the bottom of the rear of the upper receiver.

Figure 4:
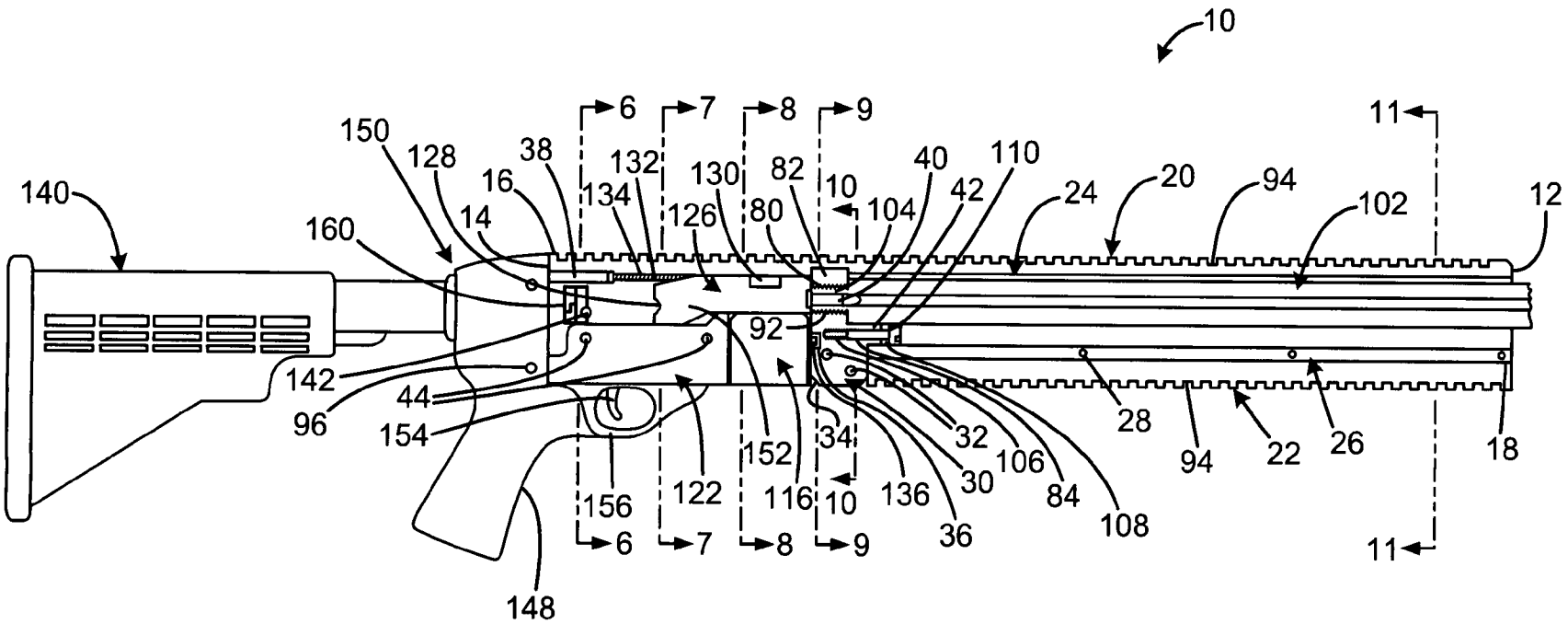
FIG. 4 is a right side sectional view of the current embodiment of the rifle upper receiver with integral magazine well of the present invention after machining assembled into a rifle.

FIG. 4 illustrates the improved rifle upper receiver with integral magazine well 10 of the present invention assembled into a rifle. The cross-section of the interior bore 24 is adapted to enable the upper receiver to receive a trunnion, various Ruger® 10/22® rifle components, a standard pistol grip, and any standard AR-15 stock to create a complete firearm. FIG. 4 shows these parts installed in the upper receiver.

A trunnion 30, which is a block that is closely received within the upper receiver's interior bore 24 at an intermediate location, defines a barrel tenon bore 92.

A barrel 102 is received in the interior bore forward of the trunnion. The barrel forms a smooth barrel tenon 104 of reduced diameter with its rear that is received by the trunnion's barrel tenon bore. The barrel has an axial barrel bore 146.

A barrel retainer 108 secures the barrel tenon within the trunnion's barrel tenon bore. Two barrel retainer screws 106 releasably secure the barrel retainer to the trunnion.

A bolt assembly 126 is received within an upper portion of the interior bore behind the trunnion. The bolt assembly's bolt 152 reciprocates along a bolt path within the upper portion of the interior bore. A guide rod channel 38 in the left side 46 of the upper receiver's interior receives the bolt assembly's guide rod 132 and spring 134.

A magazine 116 is received within the interior bore of the upper receiver behind the trunnion and below the bolt path.

A cartridge 40 is stripped out of the magazine and loaded into the barrel tenon by the bolt when the bolt slides forward into battery.

A recoil stop pin 142 is positioned within the interior bore of the upper receiver behind the bolt assembly in the bolt path.

A trigger guard assembly 122 is received within the interior bore of the upper receiver behind the magazine and below the bolt path. The trigger guard assembly includes a hammer 158 that is cocked by rearward motion of the bolt assembly and a trigger 154, which releases the hammer to discharge the firearm.

The front of a standard pistol grip is inserted into an opening in the rear 14 of the upper receiver.

A standard AR-15 stock 140 has its threaded end 150 connected to an opening in the rear of the pistol grip.

Figure 5:
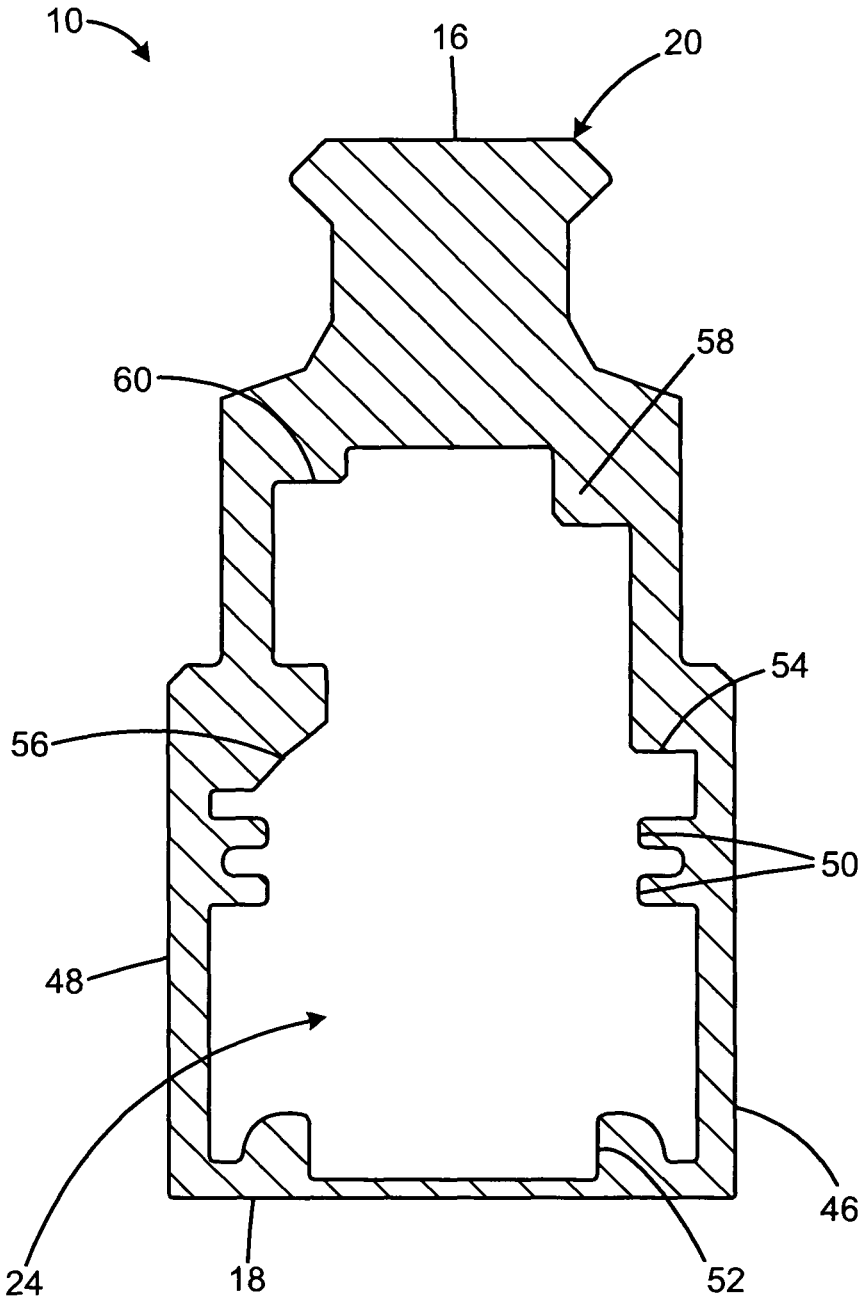
FIG. 5 is a front sectional view of the current embodiment of the rifle upper receiver with integral magazine well of the present invention immediately following extrusion and prior to any machining.

FIG. 5 illustrates the improved rifle upper receiver with integral magazine well 10 of the present invention immediately following extrusion and prior to any machining. More particularly, the upper receiver is an elongate tube with a closed-box profile. At this state of manufacture, the upper receiver has an interior bore 24 of continuous cross-section. The interior bore is defined by elements formed as surfaces of extrusion within the upper receiver's hollow interior and includes openings at the upper receiver's front 12 and rear 14. The top 16 of the upper receiver is extruded in the shape of a top rail 20 without any slots 94. The bottom 18 of the upper receiver is continuous without the bottom channel 26.

The top of the interior bore is defined by a guide rod rail 58 on the left side 46 and a bolt rail 60 on the right side 48. The guide rod rail has three faces that meet at oblique angles. The bolt rail has two faces that meet at a right angle.

A first magazine rail 54 is located about 0.600 inches below the guide rod rail 58 on the left side of the upper receiver. The first magazine rail has two faces that meet at right angles. A second magazine rail 56 is located about 0.480 inches below the bolt rail on the right side of the upper receiver. The second magazine rail has two faces that meet at right angles at its top, a concave portion that hangs beneath the upper two faces, and a lower face that connects the concave portion to the right side of the upper receiver. The second magazine rail is about 0.100 inches lower than the first magazine rail.

Two pairs of upper pin retention rails 50 are positioned across from one another on the left and right sides of the upper receiver. The upper pin retention rails are positioned about 0.171 inches below the first magazine rail and 0.071 inches below the second magazine rail. Each pair of upper pin retention rails has two members separated by a channel that extend into the interior bore.

Two lower pin retention rails 52 protrude upwards from the bottom 18 of the upper receiver. The lower pin retention rails 52 are positioned across from one another about 0.050 inches above the bottom of the upper receiver and extend upwards about 0.180 inches. The tops of the lower pin retention rails are convex.

After extrusion, the upper receiver has to undergo machining to form certain characteristics that enable it to receive parts. FIGS. 6-11 illustrate how the cross-section of the interior bore is altered as a result of the machining.

Figure 6:
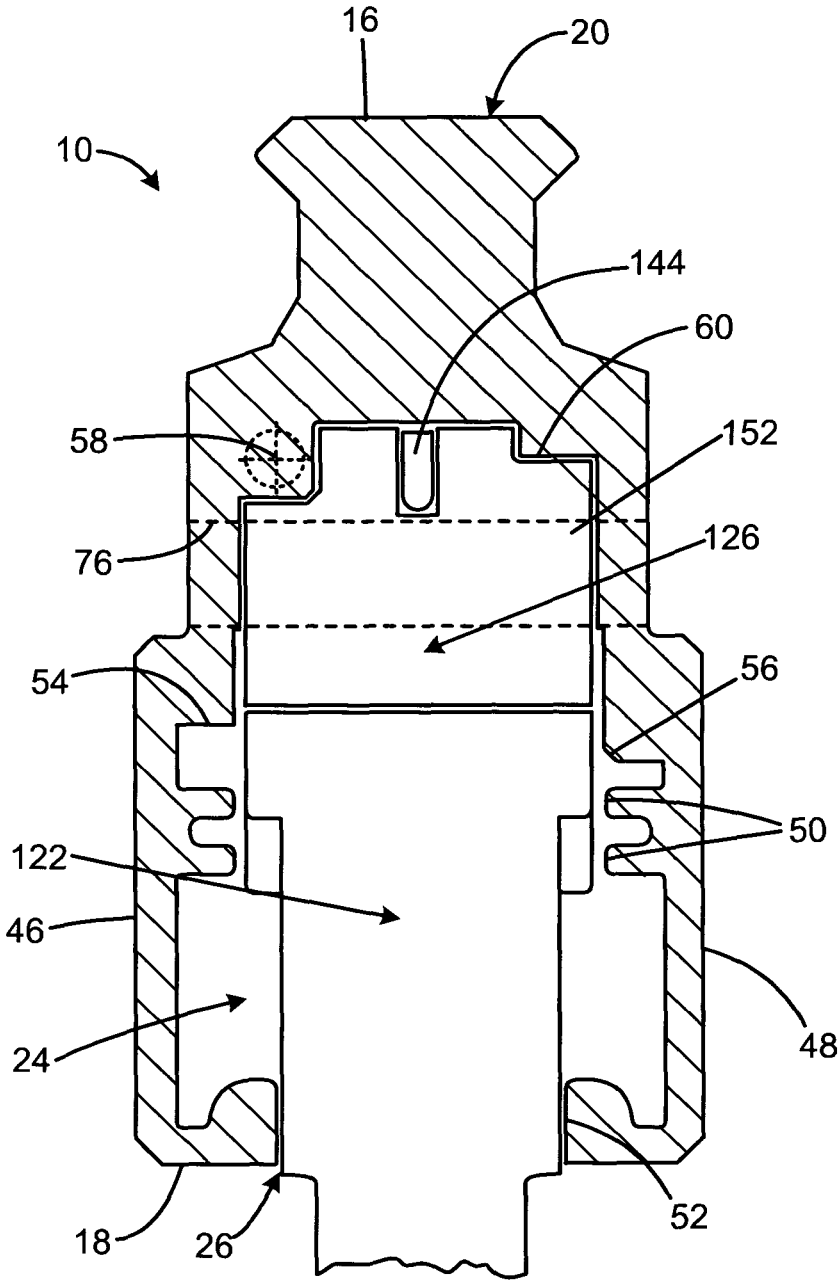
FIG. 6 is a rear sectional view taken along the line 6-6 in FIG. 4.

FIG. 6 illustrates the improved rifle upper receiver with integral magazine well 10 of the present invention after machining. More particularly, this sectional view taken along the line 6-6 in FIG. 4 shows the amount of machining required at the rear 14 of the upper receiver. Specifically, the bottom 18 between the lower pin retention rails 52 has been removed to open bottom channel 26. The first magazine rail 54 and second magazine rail 56 have been cut back to widen the interior bore 24 between them. This enables the interior bore to receive the bolt assembly 126 and trigger guard assembly 122. The bolt rail 60 and guide rod rail 58 are contoured to fit the top of the bolt 152. The guide rod rail acts as a stop to prevent the guide rod 132 and spring 134 from leaving the guide rod channel 38 as the bolt 152 reciprocates forward and backward along the bolt path within the interior bore. The upper pin retention rails 50 and lower pin retention rails 52 are positioned to prevent trigger guard assembly pins 148 that hold the components of the trigger guard assembly together from backing out of the trigger guard assembly. The recoil pin mounting holes 76 that receive the recoil stop pin 142 have been drilled through the left 46 and right 48 sides of the upper receiver.

Figure 7:
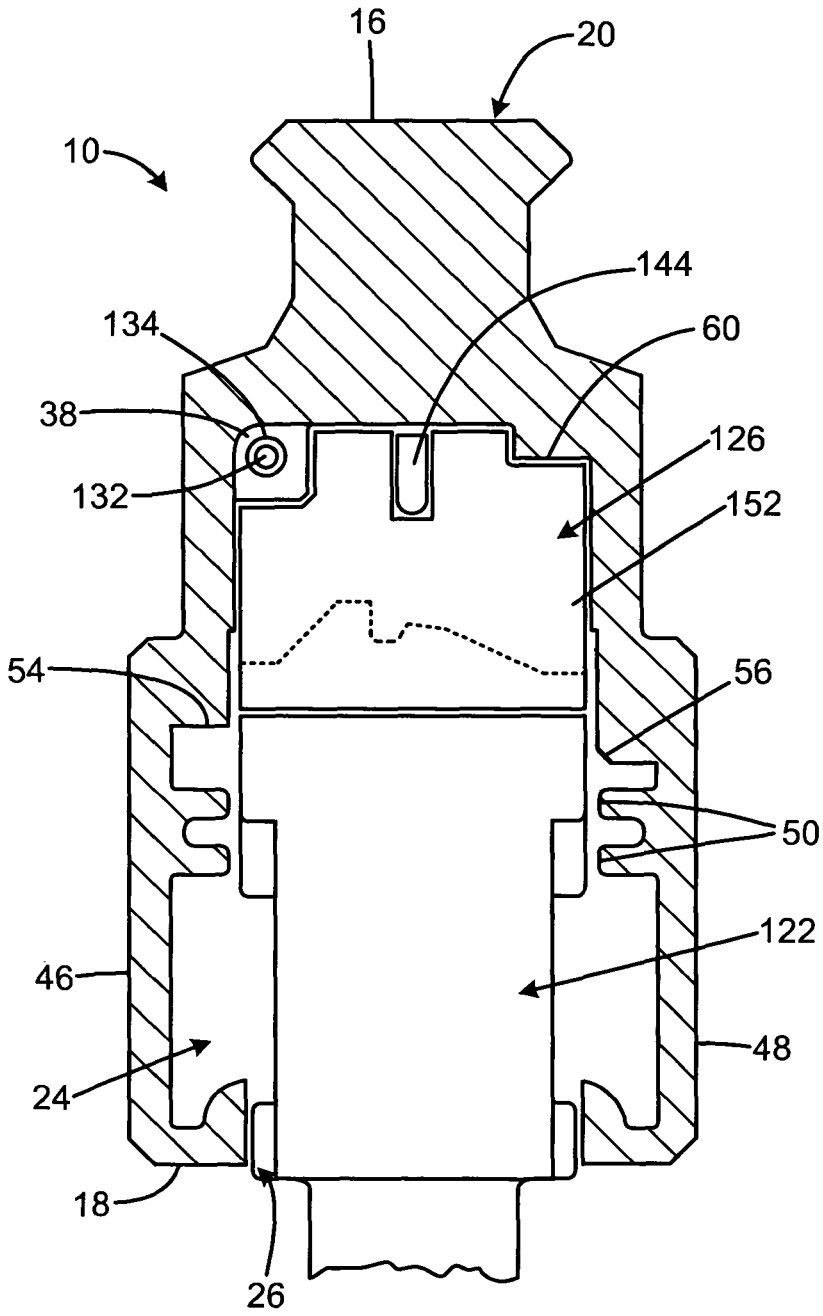
FIG. 7 is a rear sectional view taken along the line 7-7 in FIG. 4.

FIG. 7 illustrates the improved rifle upper receiver with integral magazine well 10 of the present invention after machining. More particularly, this sectional view taken along the line 7-7 in FIG. 4 shows the amount of machining required at the rear 14 of the upper receiver behind the ejection port 64. Specifically, the bottom 18 between the lower pin retention rails 52 has been removed to open bottom channel 26. A portion of the lower pin retention rails 52 has been cut away to widen the interior bore 24 to accommodate the trigger guard assembly 122. The first magazine rail 54 and second magazine rail 56 have been cut back to widen the interior bore 24 between them. This enables the interior bore to receive the bolt assembly 126 and trigger guard assembly. The bolt rail 60 and guide rod rail 58 are contoured to fit the top of the bolt 152. The guide rod rail 58 has been machined away to create the guide rod channel 38. The guide rod channel receives the guide rod 132 and spring 134.

Figure 8:
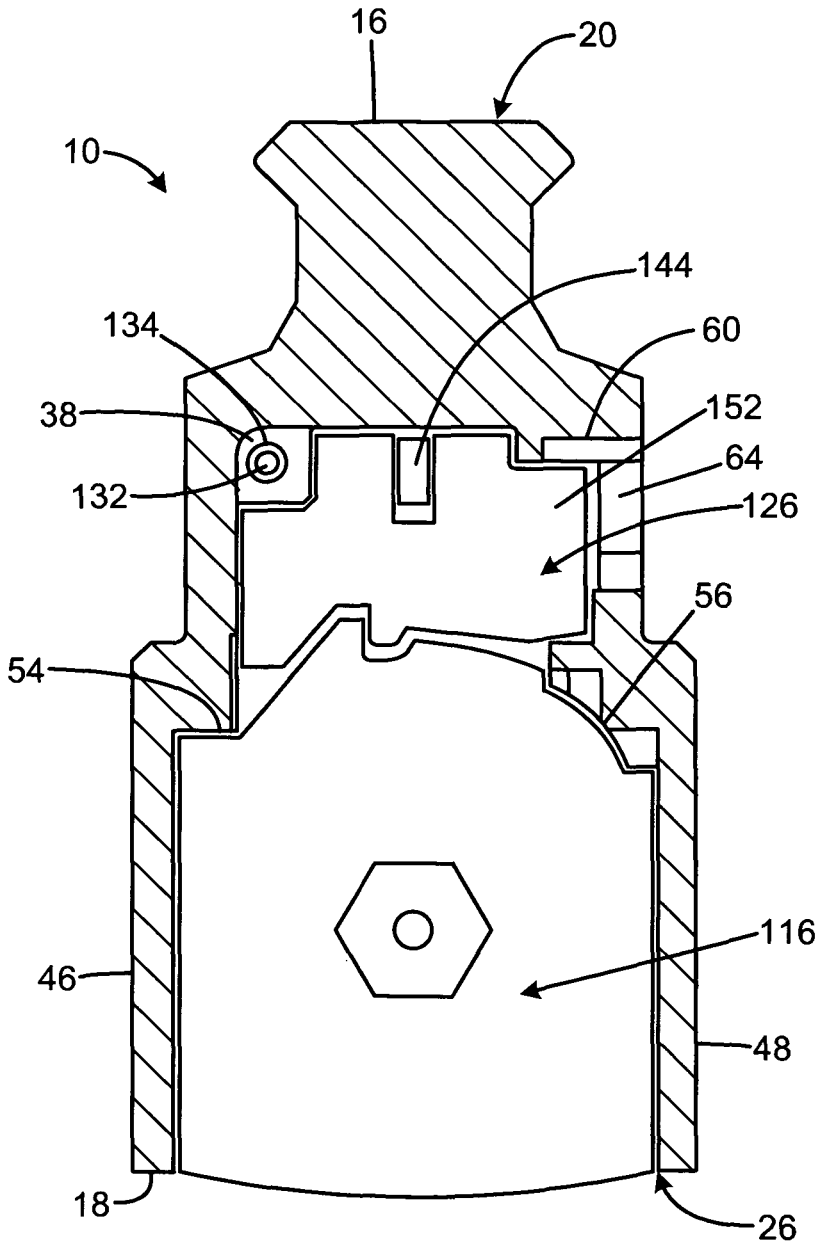
FIG. 8 is a rear sectional view taken along the line 8-8 in FIG. 4.

FIG. 8 illustrates the improved rifle upper receiver with integral magazine well 10 of the present invention after machining. More particularly, this sectional view taken along the line 8-8 in FIG. 4 shows the amount of machining required at the rear 14 of the upper receiver at the ejection port 64. Specifically, the bottom 18 and the lower pin retention rails 52 have been completely removed to open bottom channel 26 sufficiently to act as a magazine well 84 for the magazine 116. The first magazine rail 54 and second magazine rail 56 have been partially cut back to widen the interior bore 24 between them. This enables the interior bore to receive the bolt assembly 126 and trigger guard assembly 122 while the unaltered portions of the magazine rails engage the top of the magazine. The two faces of the second magazine, rail that meet at right angles at the second magazine rail's top provide the only surface the bolt rides on besides the top of the trigger group. The concave portion of the second magazine rail provides clearance for the magazine. A portion of the bolt rail 60 is removed to form the top of an ejection port 64. The guide rod rail 58 has been machined away to create the guide rod channel 38. The guide rod channel receives the guide rod 132 and spring 134.

Figure 9:
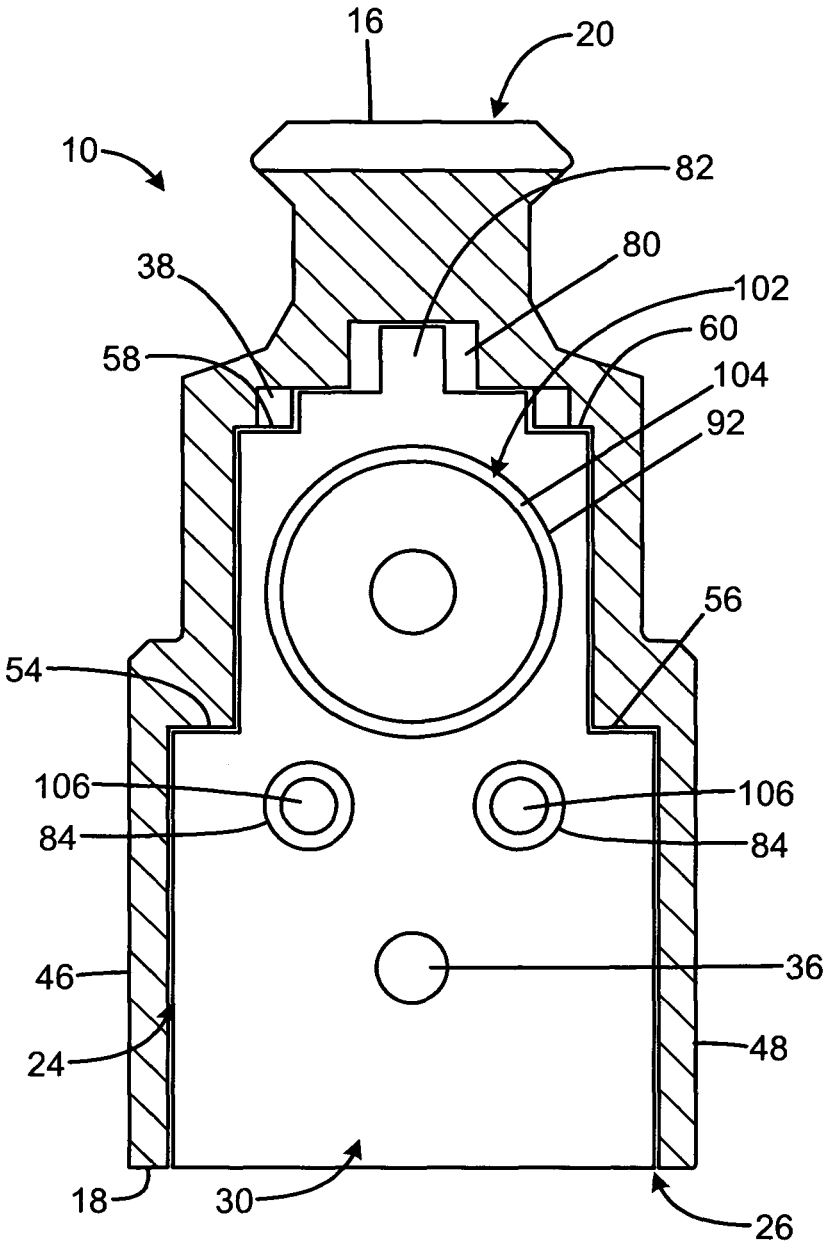
FIG. 9 is a rear sectional view taken along the line 9-9 in FIG. 4.

FIG. 9 illustrates the improved rifle upper receiver with integral magazine well 10 of the present invention after machining. More particularly, this sectional view taken along the line 9-9 in FIG. 4 shows the amount of machining required at the rear 14 of the upper receiver immediately in front of the ejection port 64. Specifically, the bottom 18 and the lower pin retention rails 52 have been completely removed to open the bottom channel 26 to accommodate the trunnion 30. The first magazine rail 54 is unaltered, while the second magazine rail 56 has been partially cut back and squared off to accommodate the trunnion. The top of the interior bore 24 has been extended to form the recoil lug hole 80 that receives the trunnion's recoil lug 82. A portion of the bolt rail 60 is removed to accommodate the trunnion. The guide rod channel 38 terminates, and an unaltered guide rod rail 58, which fits the top of the trunnion, resumes.

Figure 10:
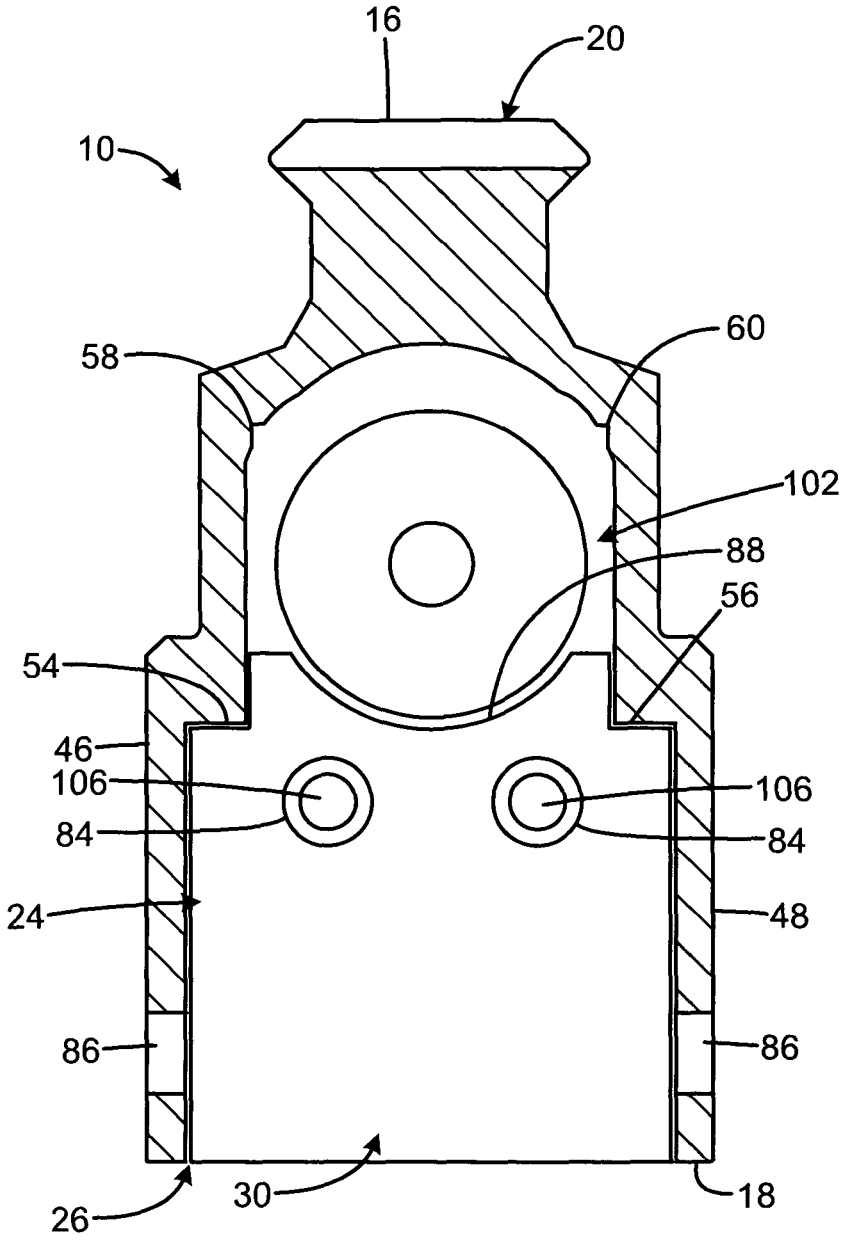
FIG. 10 is a front sectional view taken along the line 10-10 in FIG. 4.

FIG. 10 illustrates the improved rifle upper receiver with integral magazine well 10 of the present invention after machining. More particularly, this sectional view taken along the line 10-10 in FIG. 4 shows the amount of machining required at the rear 14 of the upper receiver immediately behind the rearmost lightening cut 62. Specifically, the bottom 18 and the lower pin retention rails 52 have been completely removed to open the bottom channel 26 to accommodate the trunnion 30. The first magazine rail 54 is unaltered, while the second magazine rail 56 has been partially cut back and squared off to accommodate the trunnion. The top center of the interior bore 24 is unaltered, but nearly all of the bolt rail 60 and guide rod rail 58 have been removed to form a concave shape that accommodates the barrel 102. The trunnion attachment holes 86 have been drilled to receive one of the trunnion attachment button head cap screws 32 that secure the trunnion within the upper receiver.

Figure 11:
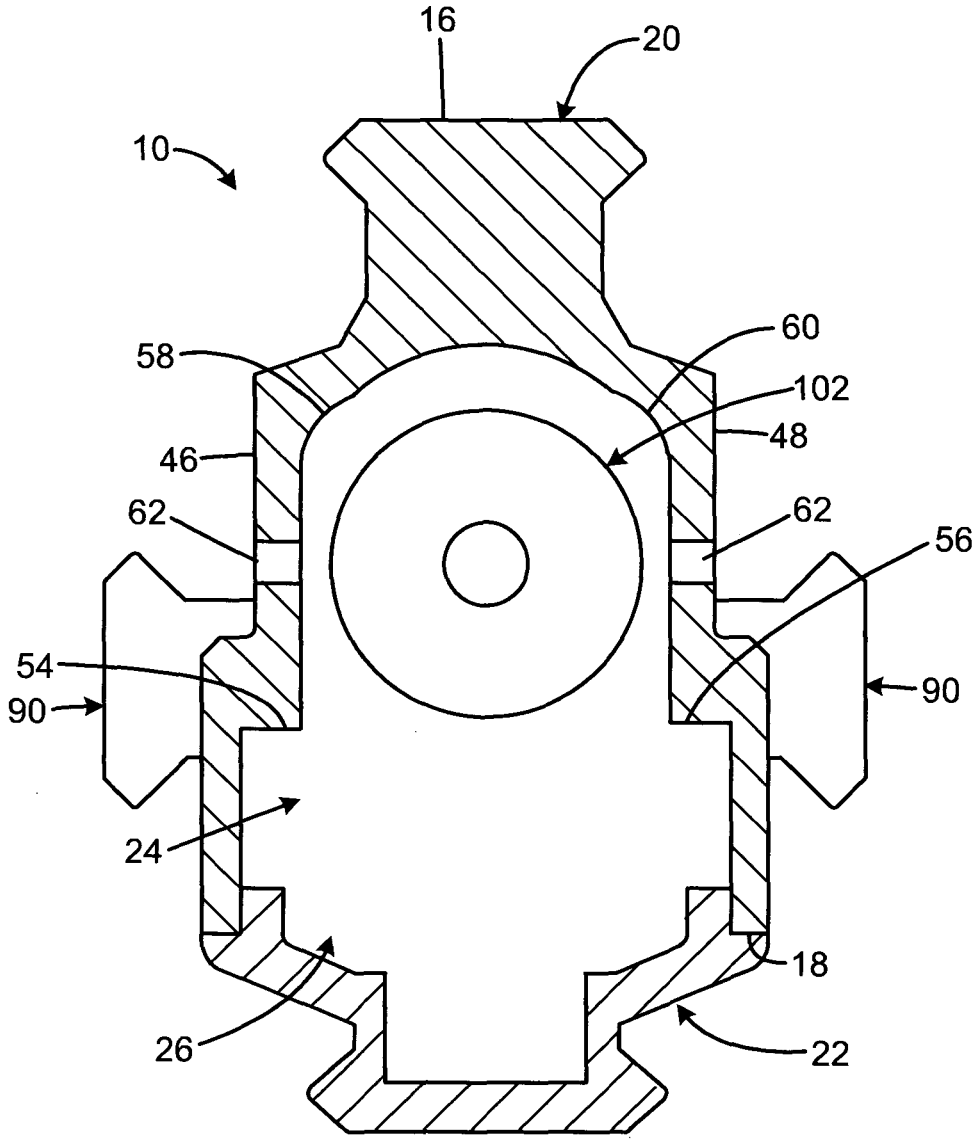
FIG. 11 is a front sectional view taken along the line 11-11 in FIG. 4.

FIG. 11 illustrates the improved rifle upper receiver with integral magazine well 10 of the present invention after machining. More particularly, this sectional view taken along the line 11-11 in FIG. 4 shows the amount of machining required at the front 12 of the upper receiver. Specifically, the bottom 18 and the lower pin retention rails 52 have been completely removed to open the bottom channel 26 to accommodate the barrel 102 and bottom rail 22. The first magazine rail 54 is unaltered, while the second magazine rail 56 has been partially cut back and squared off. The top center of the interior bore 24 is unaltered, but nearly all of the bolt rail 60 and guide rod rail 58 are removed to form a concave shape that accommodates the barrel. Optional side rails 90 are shown attached to the left side 46 and right side 48 of the upper receiver.

Referring now to FIGS. 2 and 3, how the trunnion, various Ruger® 10/22® rifle components, a standard pistol grip, and any standard AR-15 stock interact with one another and the upper receiver to create a complete firearm will be described. Specifically, the standard AR-15 stock 140 protrudes rearwardly from the upper receiver to rest against the shooter's shoulder.

The front of the pistol grip is retained within the upper receiver by pistol grip attachment screws 96. The pistol grip attachment screws close fit in holes 78 and pass laterally though the left 46 and right 48 sides of the upper receiver to be flush at the exterior surfaces of the sides. An ejection molded buffer 160 that slides into the pistol grip permits removal of the Ruger® 10/22® rifle components for regular cleaning without requiring removal of the pistol grip from the upper receiver. The removable buffer slides in and out of a recess in the pistol grip and is retained between the pistol grip and the recoil pin. The bolt cannot be retracted far enough for disassembly without first removing the buffer. The buffer also absorbs recoil forces. The pistol grip protrudes from the bottom 18 of the upper receiver and enables the shooter to grip the upper receiver with his or her shooting hand.

The trigger guard assembly is retained within the interior bore by trigger guard assembly attachment pins 44. The trigger guard assembly attachment pins close fit in holes 74 and pass laterally though the left 46 and right 48 sides of the upper receiver to be flush at the exterior surfaces of the sides. The trigger is encircled by a trigger guard 156. The trigger guard and trigger protrude from the bottom of the upper receiver. The pistol grip has a groove that receives the rear of the trigger guard, covering the rear portion of the trigger guard on each side by 0.050 to 0.100 inches.

The guide rod 132 and spring 134 are mounted in the guide rod channel 38 machined in the left side 46 of the upper receiver's interior. The guide rod 132 controls the reciprocating motion of the bolt 152 and ensures the bolt remains within the bolt path. The bolt assembly 126 ejects spent cartridges 40 from the upper receiver through the ejection port 64.

The recoil stop pin 142 is positioned beneath the guide rod channel 38 in the bolt path where it can engage with a recoil pin slot 128 in the rear of the bolt 152 to limit rearward movement of the bolt. The recoil stop pin close fits in recoil pin holes 76 and passes laterally though the left 46 and right 48 sides of the upper receiver to be flush at the exterior surfaces of the sides. The recoil pin holes receive pressed-in steel inserts to increase the recoil pin holes' durability.

The magazine has a magazine pin 146 in the front that engages a magazine pinhole 36 in the rear of the trunnion 30. The rear of the trunnion also has an oversize finger slot 34 to facilitate removal of the magazine and allow removal of the trigger guard assembly from the interior bore through the bottom channel 26. The finger slot must be oversized to enable the trigger guard assembly to be inserted into the upper receiver via the magazine well.

The trunnion has a large, smooth barrel tenon bore 92 in its top portion with two smaller threaded barrel retainer screw holes 84 positioned beneath it. The trunnion has a convex protrusion 42 extending forward beneath the barrel tenon bore 92. The top of the protrusion defines a barrel groove, which is concave in cross-section. The top of the trunnion terminates in a recoil lug 82 that fits the recoil lug hole 80 machined within the interior bore in the underside of the top of the upper receiver. The trunnion is secured within the upper receiver by two trunnion attachment button head cap screws 32. The trunnion attachment button head cap screws close fit in holes 72 and pass laterally though the left 46 and right 48 sides of the upper receiver to be protrude above the exterior surfaces of the sides.

The barrel retainer 108 has a slot 110 in its rear that receives the trunnion's front protrusion. The two barrel retainer screws 106 are inserted through the barrel retainer and threaded into the barrel retainer screw holes in the trunnion to releasably secure the barrel retainer to the trunnion. The barrel retainer cantilevers the barrel into place within the upper receiver's interior bore, leaving the barrel projecting outward with an unsupported forward end unless the harmonic dampening system is installed.

The bottom rail 22 is attached to the bottom of the upper receiver by bottom rail attachment button head cap screws 28. The bottom rail attachment button head cap screws close fit in holes 70 and pass laterally though the left 46 and right 48 sides of the upper receiver to be flush at the exterior surfaces of the sides. The bottom rail is a military specification accessory rail for attaching accessories, such as sources of illumination. The bottom rail also covers the bottom for portion of the barrel and provides a grip point for the shooter's non-shooting hand. The bottom rail is easily removed from the upper receiver to enable the barrel to be changed. The holes 70 are through holes, which enables multiple patterns of lower hand guards to be used in addition to the bottom rail illustrated. These can include, but are not limited to, a bench rest model, an integral bipod model, and a simple molded plastic hand guard model.

The series of slots 94 that are milled in the top 16 of the upper receiver form a military specification top rail 20 for attaching accessories, such as optics.

The lightening cuts in the left side 46 and right side 48 of the front 12 of the upper receiver not only impart an attractive appearance, but also they reduce the weight of the upper receiver and ventilate the barrel 102 to prevent overheating during extended fully automatic firing.

The side rail attachment points 66 enable optional side rails 90 to be attached to the upper receiver so that the upper receiver can receive additional accessories.

The harmonic dampener mounting holes 68 enable a harmonic dampener to be attached to the upper receiver. The harmonic dampener enables the user to adjust the resonance frequency of the barrel to match different types of ammunition for maximum accuracy.

The resulting assembled rifle enables training using AR-15 accessories with inexpensive .22 rimfire ammunition. The relationship of the shooter's cheek weld location to the trigger pull's position is very similar to the geometry of the AR-15, M4, M16, and other variants, further enhancing the resulting rifle's usefulness as an AR-15 training tool.

The upper receiver can be manufactured to accommodate .22 Winchester Magnum Rimfire (WMR) cartridges by simply eliminating the two rearmost lightening cuts and correspondingly decreasing the portion of the bottom of the upper receiver that is cut off to receive the bottom rail so the trunnion attachment holes and trunnion recoil lug hole can be positioned further forward. This lengthens the upper receiver's action. This increases the size of the magazine well 84 so that it can accommodate the larger magazine 116 dimensions required to accommodate .22 WMR cartridges.

Similarly, the upper receiver can be manufactured to accommodate entirely new cartridges by simply changing the length of the upper receiver's action to match the new cartridge. All the same tooling and extrusion materials can be used to manufacture the modified upper receiver. Only a modest change to the code of the Computer Numerical Controlled (CNC) program that governs the machining of the upper receiver extrusion is required to change the action's length.

The .22 WMR uses a larger case, both in diameter and length, than the more popular .22 Long Rifle (LR) cartridge does. The .22 WMR's case is thicker, allowing higher pressures. The combination of more powder and higher pressures gives velocities over 2,000 feet per second (610 m/s) from a rifle using a 30-grain (1.9 g) bullet. Given its higher chamber pressure and consequently greater rearward bolt thrust, a blowback-operated bolt assembly 126 for the .22 WMR magnum cartridge requires a bolt weighing at least twice as much as a blowback bolt for a .22 Long Rifle autoloader or the use of a stronger spring. Propelled by the greater magnum rimfire pressure, the heavier .22 WMR bolt strikes the limiting recoil stop pin 142 at the rear of the upper receiver with significantly greater force than the .22 LR versions do, so the design of the recoil stop pin and upper receiver must take this increased recoil force into consideration. The inserts in the recoil pin holes and the pistol grip buffer are examples of additional features that enable the upper receiver to be used successfully with the .22 WMR magnum cartridge While a current embodiment of the rifle scope with adjustment stop has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the upper receiver can be manufactured in any length suitable for accommodating 10/22® rifle barrels, including 11 inches, 14 inches, 18 inches, and 21 inches from a single die because the upper receiver is an extrusion. The availability of a variety of upper receiver lengths enables suppressors to be screwed onto a barrel flush with the upper receiver regardless of the barrel's length, enables rifles with different balance characteristics to be made, and enables sight radiuses to be changed easily. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle upper receiver with integral magazine well comprising:

an extruded elongate inverted U-shaped channel with an interior bore;

the channel having a top, a bottom, a left side, and a right side;

the channel having front, rear, and bottom openings;

the channel having an interior with elements formed as surfaces of extrusion;

the surfaces of extrusion providing guidance and support for a magazine and trigger guard assembly pins;

a recess in the top of the interior bore of the tube;

the recess receiving a recoil lug;

the recoil lug protruding from the top of a trunnion;

a plurality of trunnion attachment holes in the left side and right side of the channel;

the trunnion attachment holes receiving trunnion attachment screws; and the trunnion screws removably securing the trunnion to the channel.

2. The upper receiver of claim 1, further comprising:

a plurality of trigger guard assembly mounting holes in the left side and right side of channel;

the trigger guard assembly mounting holes receiving trigger guard assembly attachment pins; and the trigger guard assembly attachment pins removably securing a trigger guard assembly to the channel.

3. The upper receiver of claim 1, further comprising:

a guide rod channel defined by a slot in the top of one side of the channel;

the guide rod channel receiving a guide rod and spring; and the guide rod guiding the reciprocating motion of a bolt assembly within the interior bore of the channel.

4. The upper receiver of claim 1, further comprising:

an ejection port defined by a bore in one side of the channel; and the ejection port being in communication with the interior bore of the channel.

5. The upper receiver of claim 1, further comprising the top of the channel comprising a military specification top rail.

6. The upper receiver of claim 1, further comprising:

a plurality of bottom rail mounting holes in the bottom of the left side and right side of the channel;

the bottom rail mounting holes receiving bottom rail attachment screws;

the bottom rail attachment screws removably securing a bottom rail to the channel; and the bottom rail removably covering a portion of the bottom of the channel.

7. The upper receiver of claim 1, further comprising:

the trunnion having a barrel tenon bore; and the barrel tenon bore receiving a barrel tenon attached to a barrel.

8. The upper receiver of claim 1, further comprising:

the trunnion having a magazine pin hole; and the magazine pin hole receiving a magazine pin protruding from a magazine.

9. The upper receiver of claim 7, further comprising:

the trunnion having a barrel retainer screw hole;

the barrel retainer screw bole threadedly receiving a barrel retainer screw;

the barrel retainer screw attaching a barrel retainer to the trunnion;

the barrel retainer cantilevering the barrel into place within the tube, leaving the barrel projecting outward with an unsupported forward end.

10. The upper receiver of claim 1, further comprising:

a recoil pin mounting hole in the left side and the right side of the channel;

the recoil pin mounting holes receiving a recoil stop pin; and the recoil stop pin limiting rearward motion of a bolt assembly within the interior bore of the channel.

11. A rifle upper receiver comprising:

an extruded elongate inverted U-shaped channel with an interior bore;

the channel having a top, a bottom, a left side, and a right side;

the channel having front, rear, and bottom openings;

the channel having an interior with elements formed as surfaces of extrusion;

wherein the surfaces of extrusion provide opposed magazine support surfaces for a magazine;

wherein the surfaces of extrusion provide opposed retention surfaces for trigger guard assembly pins; and wherein the retention surfaces include two pairs of upper pin retention rails, each pair having two members separated by a channel.

12. The upper receiver of claim 11, wherein the magazine support surfaces face each other.

13. The upper receiver of claim 11, wherein at least a portion of the magazine support surfaces are parallel to each other.

14. The upper receiver of claim 11, wherein one of the opposed magazine support surfaces includes two faces that meet at right angles.

15. The upper receiver of claim 11, wherein one of the opposed magazine support surfaces includes two upper faces that meet at right angles, a concave portion that hangs beneath the two upper faces, and a lower face that connects the concave portion to a side of the upper receiver.

16. The upper receiver of claim 11, wherein the retention surfaces face each other.

17. The upper receiver of claim 11, wherein the retention surfaces are parallel to each other.

18. A rifle upper receiver comprising:

an extruded elongate inverted U-shaped channel with an interior bore;

the channel having a top, a bottom, a left side, and a right side;

the channel having front, rear, and bottom openings;

the channel having an interior with elements formed as surfaces of extrusion;

wherein the surfaces of extrusion provide opposed magazine support surfaces for a magazine;

wherein the surfaces of extrusion provide opposed retention surfaces for trigger guard assembly pins; and wherein the retention surfaces include two lower pin retention rails that protrude upwards from the bottom of the channel.

19. The upper receiver of claim 18, wherein the magazine support surfaces face each other.

20. The upper receiver of claim 18, wherein the retention surfaces face each other.

* * * * *